US005857844A

United States Patent [19]

Lifson et al.

[11] Patent Number: 5,857,844

[45] Date of Patent: Jan. 12, 1999

[54] SCROLL COMPRESSOR WITH REDUCED HEIGHT ORBITING SCROLL WRAP

[75] Inventors: Alexander Lifson, Manliu; James W. Bush, Skaneateles, both of N.Y.

[73] Assignee: Carrier Corporation, Farmington, Conn.

[21] Appl. No.: 762,414

[22] Filed: Dec. 9, 1996

[51] Int. Cl.[6] ..... F04C 18/04

[52] U.S. Cl. ..... 418/1; 418/55.2; 418/55.5; 418/57

[58] Field of Search ..... 418/1, 55.2, 55.5, 418/57

[56] References Cited

U.S. PATENT DOCUMENTS

| | | | |
|---|---|---|---|
| 4,487,248 | 12/1984 | Fukushima et al. | 164/131 |
| 4,740,143 | 4/1988 | Nakamura et al. | 418/55.4 |
| 4,989,414 | 2/1991 | Murayama et al. | 62/228.4 |
| 5,496,161 | 3/1996 | Machida et al. | 418/55.2 |

FOREIGN PATENT DOCUMENTS

| | | | |
|---|---|---|---|
| 2245487 | 10/1990 | Japan | 418/55.5 |
| 5-240174 | 9/1993 | Japan | 418/55.2 |

OTHER PUBLICATIONS

Bush et al., General Stability and Design Specification, 1992, 4 pgs.

*Primary Examiner*—John J. Vrablik
*Attorney, Agent, or Firm*—Howard & Howard

[57] ABSTRACT

An improved scroll compressor has an orbiting scroll wrap that is designed to always be at most equal in height to the fixed scroll wrap. The orbiting scroll wrap is preferably designed shorter than the fixed scroll wrap by a distance equal to the manufacturing tolerances on the height of the two scroll wraps added together. In this way, the present invention insures that in no acceptable parts will the height of the orbiting scroll wrap exceed the height of the fixed scroll wrap. In a situation where the height of the orbiting scroll wrap does exceed the height of the fixed scroll wrap, there is a tendency to limit the stable operational envelope of the system. By insuring that the orbiting scroll wrap height is always at most equal to the fixed scroll wrap height, the present invention avoids this limitation on the operational envelope.

9 Claims, 3 Drawing Sheets

SCROLL COMPRESSOR WITH REDUCED HEIGHT ORBITING SCROLL WRAP

BACKGROUND OF THE INVENTION

This invention relates to a scroll compressor wherein the height of the orbiting scroll wrap is reduced to insure that manufacturing tolerances do not result in it being longer than the fixed scroll wrap.

A known scroll compressor 20 is illustrated in FIG. 1. Scroll compressors are becoming widely used in many air conditioning and refrigeration applications, since they are relatively inexpensive, and compact. However, scroll compressors do present challenges to achieve stable operation throughout a broad operating range.

One problem encountered in scroll compressors is the stability of operation of the scroll compressor. A scroll compressor as shown in FIG. 1 includes an orbiting scroll member 22 driven by a shaft 24. A fixed scroll member 26 has a scroll wrap 28 extending from a base plate interfitting with a scroll wrap 27 extending from a base plate of orbiting scroll member 22. A pair of seals 30 and 32 in a crank case 33 define a back pressure chamber 36. Tap 34 taps fluid from scroll pockets 38 and 40 to the back pressure chamber 36. The gas tapped to the back pressure chamber 36 is utilized to counteract a separating force that is created parallel to and near the center axis of the shaft 24 tending to separate the scroll members 22 and 26. The force developed in the back pressure chamber 36 opposes this separating force, and maintains the orbiting scroll member 22 biased toward the fixed scroll member 26.

The scroll wraps 27 and 28 each extend axially for a length, and define a plurality of separated pressure pockets. These pressure pockets are continuously contracted or expanded as the orbiting scroll 22 moves relative to the fixed scroll 26. Chambers such as chamber 38 near the radially outer portion of the scroll compressor are at an intermediate pressure when compared to chambers such as chamber 40, found near the center line, which are typically at a higher or discharge pressure.

One problem with operating scroll compressors may be explained relative to FIG. 2A. As shown in FIG. 2A, the orbiting scroll 22 experiences a number of forces. A large force $F_s$ tends to push the orbiting scroll 22 downwardly and away from the fixed scroll. A force $F_b$ is the back pressure force to counteract the separating force $F_s$. In addition, a compression force $F_c$ is applied in a direction extending toward the center line of the orbiting scroll 22 due to the pressure of the fluid being compressed. Pressure force $F_c$ is a relatively large force, and creates a reaction force R between the shaft 24 and its bearing 41. The two forces $F_c$ and R are spaced by a distance A, which creates a moment $M_o$ tending to pivot or overturn the scroll 22. To counteract the movement $M_o$ the back chamber 36 and vent 34 are designed so that the back pressure force $F_b$ is significantly greater than the separating force $F_s$ which results in a reactive force $F_r$ which acts at a reaction radius r which is found at a distance from the center line axis X to the location of $F_r$ and generates the restoring moment $M_r$ which is effectively applied to orbiting scroll 22. The reaction radius r can be determined by an equation, given known design and operational characteristics for the scroll compressor 20.

It has been proven that for the scroll compressor 20 to operate under stable conditions, the reaction radius r must be less than or equal to the radius of the base plate 22*a* of orbiting scroll member 22. Thus, if Fr is at a location such as shown at 42, the required value of the reaction radius exceeds the physical size of the orbiting scroll. In such a case, the reaction radius is confined to the physical edge of the scroll, and the value of Fr can not increase. The actual restoring moment $M_r$ is less than that required to counteract the overturning movement $M_o$ and unstable operation will result. Thus, the orbiting scroll will not be in equilibrium, but instead will begin to pivot or overturn until it comes into contact with another mechanical element. This action, coupled with the orbital movement of the orbiting scroll results in a sort of wobbling motion with axial contact occurring along the edge of the part. This wobbling, or instability, results in leakage through the gaps opened by the separated wrap tips, edge loading on the scroll surfaces, and angular misalignment of the scroll drive bearing. All of these could quickly lead to loss of performance and premature failure of the compressor.

These design issues are discussed in a paper entitled "General Stability and Design Specification of the Back-Pressure Supported Axially Compliant Orbiting Scroll" which was delivered at a conference at Purdue University in 1992.

FIG. 2B shows an operational graph for scroll compressor 20 plotting the operating envelope in terms of discharge pressure versus the suction pressure for a scroll compressor. A pair of lines L1 and L2 define pressure ratios between the discharge and suction pressure and which also define the operating range for a constant reaction radius r. The lines L1 and L2 are set for a reaction radius r which corresponds to the radius of a given orbiting scroll member. An envelope P is the desired operational characteristic for a particular scroll compressor used in an air conditioning application and shows an envelope of discharge and suction pressure ratios that a design may like to achieve. Lines L1 and L2 limit the extent of the operational range for the particular compressor. If envelope P crosses lines L1 or L2, then, in the range above line L1 and below L2, the operation of the compressor may become unstable. That is, under those conditions, the reaction radius will be greater than the outermost radius where the fixed and orbiting scrolls are in contact, and non-stable operation may occur. This is undesirable.

In addition, when it is desired to utilize the scroll compressor for a refrigeration application, as opposed to standard air conditioning applications, then the operating envelope extends to lower suction and discharge pressures. This range is shown in FIG. 2*b* graphically by the dotted lines. To accommodate these additional lower pressures, it is desirable to achieve greater range between the lines L1 and L2. One way to achieve this would be to increase the radius of the orbiting scroll base plate 50. This is not practically possible, however, as it would increase the overall size of the compressor 20, which would be undesirable. One main benefit of moving to a scroll compressor in the first place is its compact size. Thus, the scroll designer typically does not want to merely increase the radius of the orbiting scroll base plate.

One complicating problem is illustrated in FIG. 3. The scroll wraps 27 and 28 are formed with a manufacturing tolerance, as are most manufactured parts. For example, for a scroll wrap having a height, or distance extending along the central axis of the scroll, between 12 mm and 75 mm, manufacturing tolerances on the order of several microns are typically utilized. Thus, tight manufacturing tolerances are maintained. Even so, taking an example of a scroll wrap having a manufacturing tolerance of 8 microns, it is possible for the fixed scroll wrap 28 to be at the short extreme of the tolerance, and the orbiting scroll wrap 27 to be at the long extreme. Thus, it is possible for the orbiting scroll wrap 27 to be as much as 16 microns longer than the fixed scroll wrap 28 for a pair of scroll members having manufacturing tolerances of plus or minus 8 microns. When the orbiting scroll wrap 27 is longer than the fixed scroll wrap 28, then the situation illustrated in FIG. 3 may occur. As shown, the tip 43 of the orbiting scroll wrap 27 abuts the base 44 of the fixed scroll 26. At the same time, the fixed scroll wrap 28 has its tip 46 spaced from the base 50 of the orbiting scroll 22. The amount of spacing is exaggerated to show the fact of the spacing. As shown, there is a perimeter cylindrical section 51 of the orbiting scroll 22 spaced radially outwardly of the outermost wrap 27. When the orbiting scroll wrap 27 abuts the fixed scroll base 44, and extends further than fixed scroll wrap 28, then the effective maximum reaction radius $r_{old}$ of the orbiting scroll 22 (for defining the limits L1 and L2 as shown in FIG. 2B) does not include the cylindrical portion 51.

Since the fixed scroll wrap 28 is not contacting the base 50 of the orbiting scroll, the effective outermost surface of the two scroll members is the location where the orbiting scroll wrap 27 contacts the fixed scroll base 44, which is at a location much closer to the centerline x than cylindrical portion 51. For that reason, the portion 51 radially outwardly of the radially outermost orbiting scroll wrap 27 is effectively not utilized in defining the outer limits for the reaction radius to achieve stable operation. Thus, when, due to manufacturing tolerances, the orbiting scroll wrap 27 is formed longer than the fixed scroll wrap 28, the particular scroll compressor may have an undesirably small effective radius $r_{old}$ for purposes of calculating the limits of the reaction radius. The portion 51 may not provide any benefit to defining the envelope as shown in FIG. 2B. This is undesirable, as it further limits the operational envelope P as shown in FIG. 2B. Moreover, since the designer did not anticipate this limitation, the compressor may be expected to operate at pressures that will now result in unstable operation.

SUMMARY OF THE INVENTION

In a disclosed embodiment of this invention, the height of the orbiting scroll wrap is intentionally made shorter than the height of the fixed scroll wrap. In this way, the scroll wraps will not result in the situation shown in FIG. 3, and the effective radius of the orbiting scroll will always include the outer portion 51 as shown in FIG. 4. In one embodiment, the orbiting scroll wrap is designed to be shorter than the height of the fixed scroll wrap by a very small distance. This height difference is preferably less than 45 microns, and more preferably less than 10 microns.

In a most preferred embodiment of this invention, the orbiting scroll wraps are designed to have a height that is a distance less than the design height of the fixed scroll wrap, determined to be the combined manufacturing tolerances for the fixed and orbiting scroll wraps. The present invention thus insures that every scroll compressor formed utilizing this invention will have a fixed scroll wrap that is at least as long as the orbiting scroll wrap. In this way, the situation illustrated in FIG. 3 will not occur, and the effective radius of the orbiting scroll will include the outer portion 51 as shown in FIG. 4. Thus, the lines L1 and L2 for any given compressor will be further apart and will allow as much envelope freedom as is possible for the particular compressor design.

In other features of this invention, the scroll wraps could be formed with a dish shape where the inner wraps are slightly shorter than the outer wraps. Dish shaped scroll wraps are known in the art. These scroll wraps are utilized such that when the more central portions of the wrap expand due to higher temperatures at the central portions, the dishing accommodates this expansion. When the present invention is applied to a dish shaped scroll wrap, at least the outermost longer wraps are formed to have the shortened height as discussed above. More preferably, all of the wraps on the orbiting scroll are formed to be of the shorter height.

These and other features of the present invention can be best understood from the following specification and drawings, of which the following is a brief description.

DETAILED DESCRIPTION OF PREFERRED EMBODIMENTS

Figure 4:
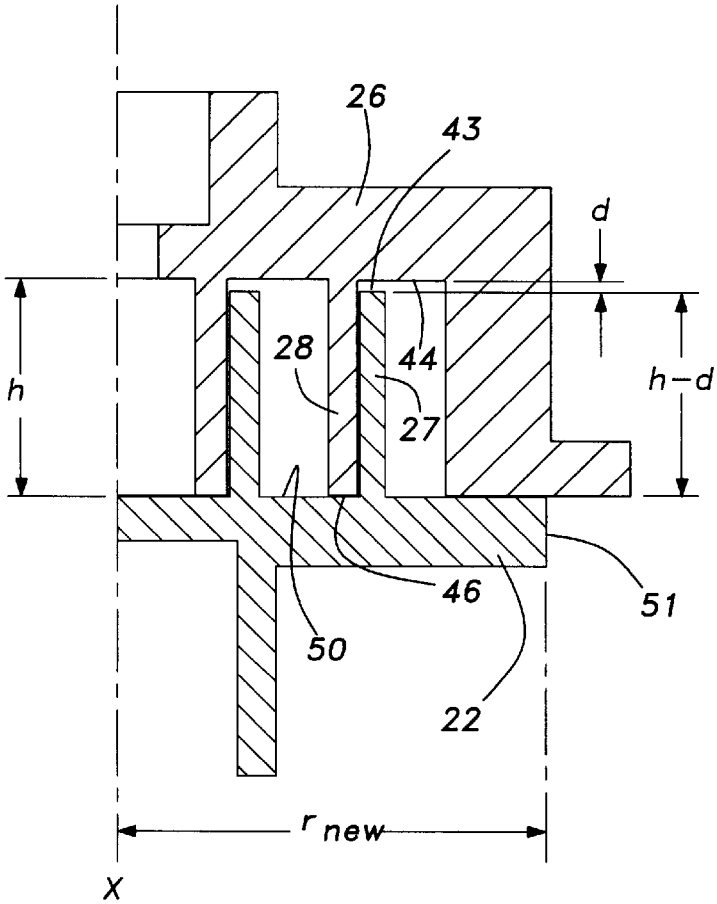
FIG. 4 shows a first embodiment of the present invention.

As discussed above, the present invention seeks to insure that the height of the orbiting scroll wrap is at most equal to the height of the fixed scroll wrap. To that end, FIG. 4 shows a first embodiment 59 wherein the fixed scroll 26 has a wrap 28 extending for a height h. The orbiting scroll 22 has a wrap 27 that extends for a height h−d. The scroll wraps 27 and 28 are designed to have these heights. The distance d is preferably less than 45 microns. More preferably, the distance d is less than 10 microns. Most preferably, the distance d is selected to be equal to the manufacturing tolerance on the height h for the fixed scroll wrap 28, plus the manufacturing tolerance for the height of the orbiting scroll wrap 27. In this way, the distance d would be equal to a "worst case" scenario for the orbiting scroll wrap 28 being longer than fixed scroll wrap 27. Thus, the present invention insures that the orbiting scroll wrap 27 will not abut the base 44 of the fixed scroll 26, without contact between the tip 46 of the fixed scroll wrap 28 and the outer portion 51 of the orbiting scroll 22. In this way, the present invention insures that the radially outer peripheral portion 51 of the orbiting scroll 22 will perform a function in defining the outermost limit for the reaction radius $r_{new}$.

Figure 5:
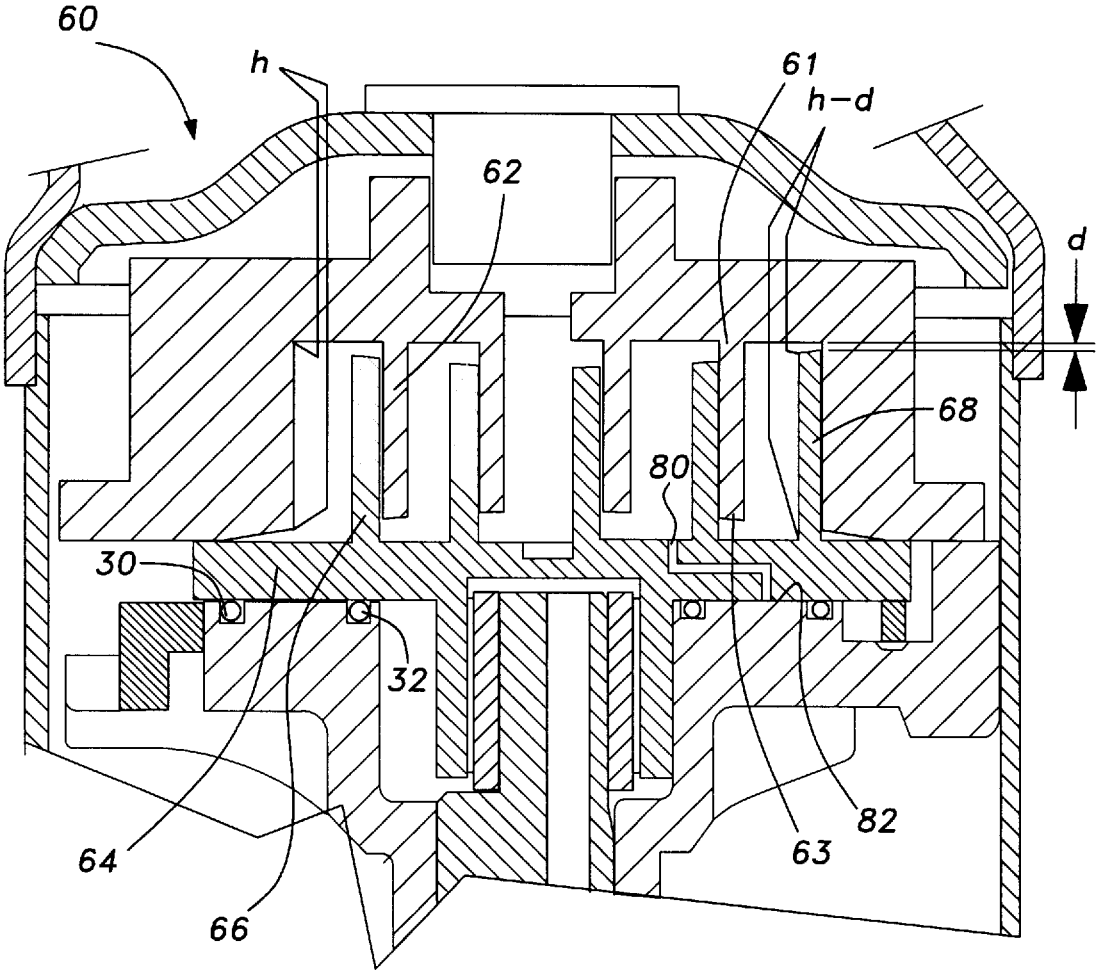
FIG. 5 shows a second embodiment of the present invention.

FIG. 5 shows a second embodiment 60 wherein the fixed scroll 61 has a dished wrap 62. As is known, the outermost wrap 63 extends for a height h that is greater than the height of the wraps spaced radially inwardly from the outermost wrap 63.

Similarly, the orbiting scroll 64 has a wrap 66 with its radially outermost portion 68 extending for a height h minus d that is greater than the height of the radially inner wrap portions. The dish shape allows thermal expansion of the central portions, which heat to a higher extent than do the outer portions, such that that expanded length is accommodated. This feature of the invention is as known, and forms no portion of the invention.

Figure 1:
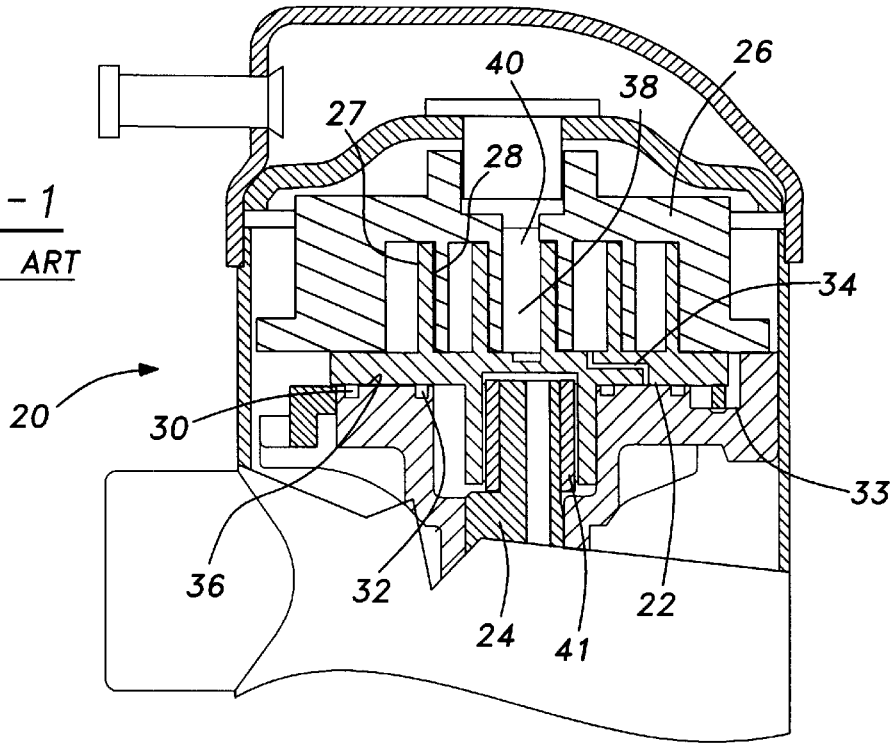
Fig-1 PRIOR ART
FIG. 1 shows a prior art scroll compressor.
Figure 2A:
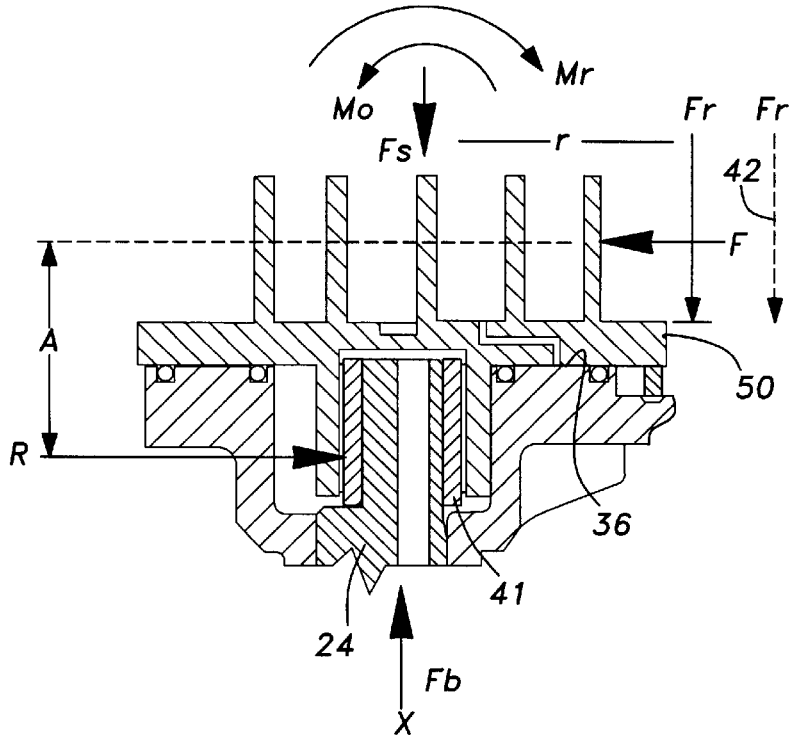
Fig-2A PRIOR ART
FIG. 2A shows a problem in the prior art.
Figure 2B:
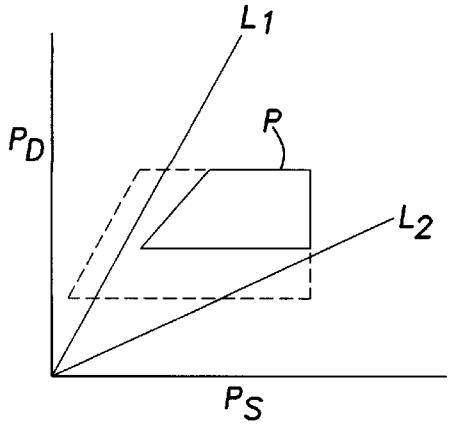
Fig-2B PRIOR ART
FIG. 2B shows operational features of the prior art.

As can be seen in FIG. 5, the inventive scroll compressor is provided with a back pressure chamber 82 as in the prior art FIG. 1 embodiment. A tap 80 supplies fluid to the chamber 82, as in the prior embodiment. The FIG. 4 embodiment is provided with the same back chamber structure.

Figure 3:
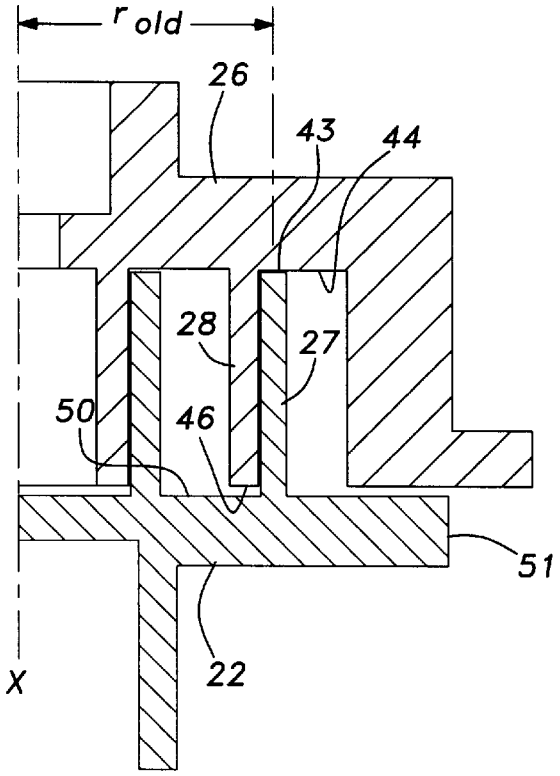
Fig-3 PRIOR ART
FIG. 3 shows another problem in the prior art.

However, the present invention insures that the dished wraps 66 on the orbiting scroll 64 are shorter than the corresponding location of the dished wraps 62 on the fixed scroll 61 by a distance d such that the occurrence shown in FIG. 3 does not occur. Again, the distance d may be selected by adding the desired tolerances of the two scroll wraps. Preferably, the entire spiral length of the orbiting scroll dish shaped wrap is designed shorter than the fixed scroll wrap.

Preferred embodiments of this invention have been disclosed, however, a worker of ordinary skill in the art would recognize that certain modifications will come within the scope of this invention. For that reason, the following claims should be studied to determine the true scope and content of this invention.

We claim:

1. A scroll compressor comprising:

a non-orbiting scroll having a helical scroll wrap extending from a base in a first actual direction;

an orbiting scroll having a helical wrap extending from a base in a direction opposed to said first direction, said scroll wraps on said orbiting and non-orbiting scrolls interfitting to define a plurality of the pressure pockets, a back pressure chamber defined behind one of said orbiting and non-orbiting scroll base members, and a fluid communication line for supplying fluid from at least one of said pressure pockets to said back pressure chamber; and said scroll wrap on the other of said orbiting and non-orbiting scrolls extending from said base by a first distance, said scroll wrap on said one of said orbiting and non-orbiting scrolls extending from its base by a second distance, said second distance being designed to be less than said first distance.

2. A scroll compressor as recited in claim 1, wherein said one scroll member is said orbiting scroll member.

3. A scroll compressor comprising:

a non-orbiting scroll having a helical scroll wrap extending from a base in a first axial direction;

an orbiting scroll having a helical wrap extending from a base in a direction opposed to said first direction, said scroll wraps on said orbiting and non-orbiting scrolls interfitting to define a plurality of pressure pockets, and a back pressure chamber defined behind said orbiting scroll base, a fluid line supplying a refrigerant to said back pressure chamber from one of said pressure pockets; and said scroll wrap on said fixed scroll extending from said fixed scroll base by a first distance, said scroll wrap on said orbiting scroll base extending from said orbiting scroll base by a second distance, said second distance being designed to be shorter than said first distance.

4. A scroll compressor as recited in claim 3, wherein said second distance is shorter than said first distance by an amount less than 45 microns.

5. A scroll compressor as recited in claim 4, wherein said second distance is less than said first distance by an amount less than or equal to 10 microns.

6. A scroll compressor as recited in claim 3, wherein said second distance is shorter than said first distance by an amount approximately equal to a manufacturing tolerance on said height of said fixed scroll wrap plus the manufacturing tolerance on the height of said orbiting scroll wrap.

7. A scroll compressor as recited in claim 3, wherein said scroll wraps have a dish shaped configuration such that said first and second distances become smaller moving towards a radial center line of said scroll members.

8. A method of forming a scroll compressor comprising the steps of:

designing a non-orbiting scroll having a helical scroll wrap extending from a base in a first direction, and for a first distance;

designing an orbiting scroll having a helical scroll wrap extending from a base for a second distance;

designing a back pressure chamber behind said base of one of said orbiting and non-orbiting scroll wraps, and designing a communication line for supplying fluid from chambers defined between said wraps of said orbiting and scroll wraps to said back pressure chamber; and forming the distance associated with said one of said orbiting and non-orbiting scroll wraps to be shorter than the distance of the other of said orbiting and non-orbiting scroll wraps.

9. A method as recited in claim 8, wherein said amount is selected by adding the manufacturing tolerance from the height of said fixed scroll wrap to the manufacturing tolerance on the height of said orbiting scroll wrap.

* * * * *